US007727636B2

(12) United States Patent
Genjima

(10) Patent No.: US 7,727,636 B2
(45) Date of Patent: Jun. 1, 2010

(54) COATING MATERIAL COMPOSITION FOR CHROMIUM PLATING AND ARTICLE COMPRISING COATING FILM MADE OF THE SAME

(75) Inventor: Yasuhiro Genjima, Hanno (JP)

(73) Assignee: Origin Electric Company Limited, Tokyo (JP)

( * ) Notice: Subject to any disclaimer, the term of this patent is extended or adjusted under 35 U.S.C. 154(b) by 796 days.

(21) Appl. No.: 11/551,958

(22) Filed: Oct. 23, 2006

(65) Prior Publication Data

US 2007/0092741 A1 Apr. 26, 2007

(30) Foreign Application Priority Data

Oct. 25, 2005 (JP) ..... 2005-309537

(51) Int. Cl.
*B32B 15/04* (2006.01)
*C09D 133/14* (2006.01)

(52) U.S. Cl. ..... 428/450; 428/451; 428/463; 524/265

(58) Field of Classification Search ..... 428/450, 428/451, 463; 524/265
See application file for complete search history.

(56) References Cited

U.S. PATENT DOCUMENTS

2003/0205481 A1 * 11/2003 Xu et al. ..... 205/319

FOREIGN PATENT DOCUMENTS

JP 05-255636 10/1993
WO WO 2004/098796 A1 * 11/2004

* cited by examiner

*Primary Examiner*—D. S Nakarani
(74) *Attorney, Agent, or Firm*—Wood, Herron & Evans, L.L.P.

(57) ABSTRACT

According to the present invention, there are provided a coating material composition for chromium plating, which can maintain high adhesion to the chromium plated surface of a chromium plated material having reduced adhesion for a long period and also can form a coating film having excellent chemical resistance, and an article comprising a coating film made of the same. The coating material composition for chromium plating, comprises a vinyl-based polymer (A) obtained by polymerizing a vinyl-based monomer mixture containing a vinyl-based monomer having an amino group, and a compound (B) having an epoxy group and a hydrolyzable silyl group in a molecule, wherein the vinyl-based polymer (A) has a glass transition temperature of lower than 30° C., and the content of the vinyl-based monomer having an amino group is 5% by weight or more and less than 20% by weight in the vinyl-based monomer mixture (100% by weight).

4 Claims, 1 Drawing Sheet

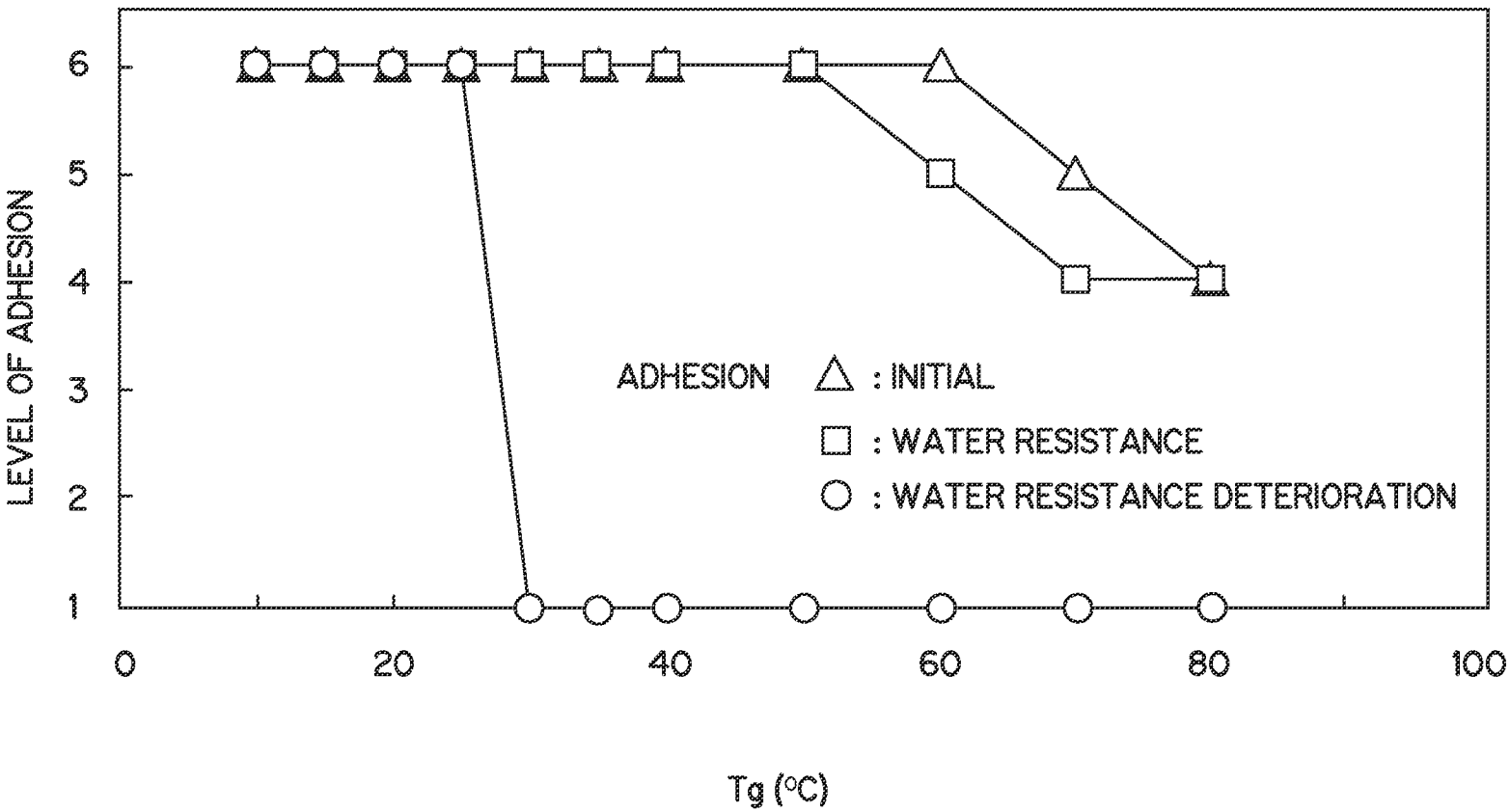
LEVEL OF ADHESION
6
5
4
3
2
1
0
20
40
60
80
100
Tg (°C)
ADHESION
△ : INITIAL
□ : WATER RESISTANCE
○ : WATER RESISTANCE DETERIORATION

COATING MATERIAL COMPOSITION FOR CHROMIUM PLATING AND ARTICLE COMPRISING COATING FILM MADE OF THE SAME

BACKGROUND OF THE INVENTION

1. Field of the Invention

The present invention relates to a coating material composition for chromium plating, and an article comprising a coating film made of the same Priority is claimed on Japanese Patent Application No 2005-309537 filed Oct. 25, 2005, the content of which is incorporated herein by reference.

2. Description of the Related Art

As components such as radiator grilles and license garnishes of automobiles, components obtained by subjecting a base material made of an acrylonitrile-styrene-butadiene resin (hereinafter abbreviated to ABS) to chromium plating are used. For the purpose of imparting design properties, the portion excluding a partial chromium plated surface of the components is subjected to coating such as clear coating. To the coating material used for coating, it is required that the resulting coating film has high adhesion to the chromium plated surface and the resulting coating film has resistance to acid and gasoline (chemical resistance).

As a coating material composition which can form a coating film having excellent adhesion to metal or the like, a coating material composition containing an acrylic resin having a basic nitrogen and a compound having an epoxy group arid a hydrolyzable silyl group in a molecule is known (see Japanese Unexamined Patent Application, First Publication No. Hei 5-255636).

The coating film made of the coating material composition has high adhesion to the chromium plated surface immediately after coating, but has such a problem that adhesion to a chromium plated material, which has reduced adhesion caused by adherent residues in the chromium plating step or storage environment before coating, is reduced and thus peeling of the coating film occurs.

SUMMARY OF THE INVENTION

An object of the present invention is to provide a coating material composition for chromium plating, which can maintain high adhesion to the chromium plated surface of a chromium plated material having reduced adhesion for a long period and also can form a coating film having excellent chemical resistance, and an article comprising a coating film made of the same.

The coating material composition for chromium plating of the present invention includes a vinyl-based polymer (A) obtained by polymerizing a vinyl-based monomer mixture containing a vinyl-based monomer having an amino group, and a compound (B) having an epoxy group and a hydrolyzable silyl group in a molecule, wherein the vinyl-based polymer (A) has a glass transition temperature of lower than 30° C., and the content of the vinyl-based monomer having an amino group is 5% by weight or more and less than 20% by weight in the vinyl-based monomer mixture (100% by weight).

It is preferred that the coating material composition for chromium plating of the present invention further contains a compound (C) having a hydrolyzable silyl group other than the compound (B).

It is preferred that the compound (C) having a hydrolyzable silyl group is a mixture of a partial hydrolyzate condensate (C1) of tetramethoxysilane and a partial hydrolyzate condensate (C2) of tetramethoxysilane and a weight ratio of the partial hydrolyzate condensate (C1) to the partial hydrolyzate condensate (C2), (C1/C2), is from ½ to ¼.

The article of the present invention includes a chromium plated base material and a coating film made of the coating material composition for chromium plating of the present invention formed on the chromium plated surface of the base material.

The chromium plated surface of the base material is preferably pretreated with an organic silicon compound.

The coating material composition for chromium plating of the present invention can maintain high adhesion to the chromium plated surface of a chromium plated material having reduced adhesion for a long period, and also can form a coating a film having excellent chemical resistance.

The article of the present invention can suppress peeling a coating film from the chromium plated surface for a long period and is excellent in chemical resistance of the surface.

The above and other objects, features, and advantages of the present Invention will be apparent from the following description when taken in conjunction with the accompanying drawing which illustrates preferred embodiments of the present invention by way of example.

BRIEF DESCRIPTION OF THE DRAWING

FIG. 1 is a graph showing a correlation between the glass transition temperature (Tg) of a vinyl-based polymer (A) and the adhesion of a coating film to the chromium plated surface.

DETAILED DESCRIPTION OF THE INVENTION (Vinyl-based polymer (A))

The vinyl-based polymer (A) is a polymer obtained by polymerizing a vinyl-based monomer mixture containing a vinyl-based monomer having an amino group and the other vinyl-based monomer using a polymerization initiator Examples of the vinyl-based monomer having an amino group include dialkylaminoalkyl(meth)acrylates such as dimethylaminoethyl(meth)acrylate, diethylaminoethyl (meth)acrylate, dimethylaminopropyl(meth)acrylate, dialkylaminoalkyl(meth)acrylate and the like; N-dialkylaminoalkyl (meth)acrylamides such as N-dimethylaminoethyl(meth) acrylamide, N-diethylaminoethyl (meth)aorylamide, N-dimethyleminopropyl(meth)acrylamide, N-diethylaminopropyl(meth)acrylamide and the like; and t-butylaminoethyl (meth)acrylate, t-butylaminopropyl(meth)acrylate and the like. Among these monomers, dialkylaminoalkyl(meth)acrylates and N-dialkylaminoalkyl(meth)acrylamides are preferable in view of coating film hardness. In the present invention, "(meth)acrylate" means an acrylate and/or a methacrylate, and "(meth)acrylamide" means an acrylamide and/or a methacrylamide.

The content of the vinyl-based monomer having an amino group is 5% by weight or more and less than 20% by weight, and preferably from 5 to 15% by weight, in the vinyl-based monomer mixture (100% by weight). Gasoline resistance of the coating film is improved by adjusting the content of the vinyl-based monomer having an amino group to 5% by weight or more. Adhesion to the chromium plated surface and acid resistance of the resulting coating film are improved by adjusting the content of the vinyl-based monomer having an amino group to less than 20% by weight.

Examples of the other vinyl-based monomer include (meth)acrylate esters, carboxyl group-containing vinyl-based monomer, dialkyl esters of an unsaturated dibasic acid, acid anhydride group-containing vinyl-based monomer, carboxylic acid amide group-containing vinyl-based monomer, sulfonamide group-containing vinyl-based monomer, (per)fluoroalkyl group-containing vinyl-based monomer, aromatic vinyl-based monomer and the like. In the present invention, "(meth)acrylic acid" means an acrylic acid and/or a methacrylic acid.

Examples of the (meth)acrylate esters include methyl (meth)acrylate, ethyl(meth)acrylate, n-propyl(meth)aorylate, iso-propyl(meth)acrylate, n-butyl(meth)acrylate, iso-butyl(meth)acrylate, tert-butyl(meth)acrylate, 2-ethylhexyl (meth)acrylate and the like.

Examples of the carboxyl group-containing vinyl-based monomer include (meth)acrylic acid, maleic acid, fumaric acid, itaconic acid and the like.

Examples of the dialkyl esters of the unsaturated dibasic acid include dimethyl maleate, dimethyl fumarate and the like.

Examples of the acid anhydride group-containing vinyl-based monomer include maleic anhydride, itaconic anhydride and the like.

Examples of the carboxylic acid amide group-containing vinyl-based monomer include (meth)acrylamide, N-alkoxy (meth)acrylamide and the like.

Examples of the sulfonamide group-containing vinyl-base monomer include p-styrenesulfonamide and the like.

Examples of the (per)fluoroalkyl group-containing vinyl-based monomer include perfluorocyclohexyl(meth)acrylate and the like.

Examples of the aromatic vinyl-based monomer include styrene and a-methylstyrene and the like.

Examples of the polymerization initiator include peroxide such as benzoyl peroxide, t-butylperoxy-2-ethylhexanoate or the like, and azo compound such as azobisisobutyronitrile, azobisdimethylvaleronitrile or the like.

The glass transition temperature of the vinyl-based polymer (A) is preferably lower than 30° C., and particularly preferably from 10 to 25° C. High adhesion can be maintained for a long period by adjusting the glass transition temperature of the vinyl-based polymer (A) to lower than 30° C. Also sufficient coating film hardness is obtained by adjusting the glass transition temperature of the vinyl-based polymer (A) to 10° C. or higher.

In case of a copolymer including monomers a, b, c . . . , the glass transition temperature (Tg) of the vinyl-based polymer (A) is obtained by the following equation (FOX's equation):

$$1/Tg=ma/Tga+mb/Tgb+mc/Tgc+\ldots$$

wherein ma: weight fraction of a monomer a, Tga: Tg [K] of a homopolymer obtained from the monomer a, mb: weight fraction of a monomer b, Tgb: Tg [K] of a homopolymer obtained from the monomer b, and mc: weight fraction of a monomer c, Tgc: Tg [K] of a homopolymer obtained from the monomer c.

The weight-average molecular weight of the vinyl-based polymer (A) is preferably from 10,000 to 50,000, and particularly preferably from 15,000 to 30,000. When the weight-average molecular weight of the vinyl-based polymer (A) is 10,000 or more, the resulting coating film has sufficient gasoline resistance. When the weight-average molecular weight of the vinyl-based polymer (A) is 50,000 or less, stringiness does not occur during coating and coatability is improved. The weight-average molecular weight of the vinyl-based polymer (A) is a styrene equivalent weight-average molecular weight determined using gel permeation chromatography (GPC).

(Compound (B))

The compound (B) is a compound having an epoxy group and a hydrolyzable silyl group in a molecule. Examples of the compound (B) include a silane coupling agent (B1) having an epoxy group, and a vinyl-based polymer (B2) having an epoxy group and a hydrolyzable silyl group.

Examples of the silane coupling agent (B1) having an epoxy group include 3-glycidoxypropyltrimethoxysilane, 3-glycidoxypropylymethyldimethoxysilane, 3-glycidoxypropyltriethoxysilane, 3-glycidoxypropylmethyldiethoxysilane and the like.

The vinyl-based polymer (B2) is a polymer obtained by polymerizing a vinyl-based monomer having an epoxy group, a vinyl-based monomer having a hydrolyzable silyl group and, if necessary, the other vinyl-based monomer. Examples of the vinyl-based monomer having an epoxy group include (β-methyl)glycidyl(meth)acrylate, allyl glycidyl ether and the like. Examples of the vinyl-based monomer having a hydrolyzable silyl group include 3-(meth)acryloyloxypropyltrimethoxysilane, 3-(meth)acryloyloxypropylmethyldimethoxysilane, vinyltritrimethoxysilane, vinyltriethoxysilane and the like. Examples of the other vinyl-based monomer include the other vinyl-based monomers described above and the like.

(Compound (C))

The compound (C) is a compound having a hydrolyzable silyl group other than the compound (B).

Examples of the compound (C) include alkoxysilanes, alkenyloxysilanes, acyloxysilanes, halosilanes, a partial hydrolyzate condensate of alkoxysilanes, a partial hydrolyzate condensate of alkenyloxysilanes and the like.

Examples of the alkoxysilanes include tetramethoxysilane, tetramethoxysilane, tetrabutoxysilane, methyltrimethoxysilane, methyltrimethoxysilane, methyltriethoxysilane, diphenyldiethoxysilane and the like.

Examples of the alkenyloxysilanes include tetraisopropenyloxysilane, phenyltriisopropenyloxysilane and the like.

Examples of the acyloxysilanes include tetramethoxysilane, 3-mercaptopropyltriacetoxysilane and the like.

Examples of the halosilanes include tetrachlorosilane, phenyltrichlorosilane and the like.

Among these compounds, a partial hydrolyzate condensate of alkoxysilanes is preferable, and a mixture of a partial hydrolyzate condensate (C1) of tetramethoxysilane and a partial hydrolyzate condensate (C2) of tetramethoxysilane is particularly preferable in view of hardness, gasoline resistance and wax remover resistance of the coating film. As the partial hydrolyzate condensate (C1), a tri- to pentamer of tetramethoxysilane is preferable. As the partial hydrolyzate condensate (C2), a tetra- to hexamer of tetramethoxysilane is preferable.

In the above mixture, a weight ratio of the partial hydrolyzate condensate (C1) to the partial hydrolyzate condensate (C2), (C1/C2), is preferably from ½to ¼. When the weight ratio of the partial hydrolyzate condensate (C1) to the partial hydrolyzate condensate (C2) is within the above range, balance between pot life and coating film strength of the coating material is improved.

(Coating Material Composition for Chromium Plating)

The coating material composition for chromium plating of the present invention is a coating material composition containing a vinyl-based polymer (A), a compound (B) and, if necessary, a compound (C).

When the compound (C) is not added, the content of the vinyl-based polymer (A) is preferably from 60 to 98% by weight, and particularly preferably from 80 to 98% by weight, in 100% by weight of the total amount of the vinyl-based polymer (A) and the compound (B).

When the content of the vinyl-based polymer is within the above range; high adhesion to the chromium plated surface can be maintained for a long period and also a coating film having excellent chemical resistance can be formed.

When the compound (C) is not added, the content of the vinyl-based polymer (B) is preferably from 2 to 40% by weight, and particularly preferably from 2 to 20% by weight, in 100% by weight of the total amount of the vinyl-based polymer (A) and the compound (B). When the content of the vinyl-based polymer (B) is within the above range, high adhesion to the chromium plated surface can be maintained for a long period and also a coating film having excellent chemical resistance can be formed.

When the compound (C) is added, the content of the compound (C) is preferably from 2 to 40% by weight, and particularly preferably from 12 to 20% by weight, in 100% by weight of the total amount of the vinyl-based polymer (A), the compound (B) and the compound (C). When the content of the compound (C) is within the above range, hardness, gasoline resistance and wax remover resistance of the coating are improved. When the compound (C) is added, the content of the vinyl-based polymer (A) is preferably from 60 to 90% by weight, and particularly preferably from 70 to 80% by weight, in 100% by weight of the total amount of the vinyl-based polymer (A), the compound (B) and the compound (C). The content of the compound (B) is preferably from 5 to 20% by weight, and particularly preferably from 10 to 15% by weight.

If necessary, the coating material composition for chromium plating of the present invention may contain additives such as catalysts for hydrolysis and condensation, color pigments, dyes, extender pigments, ultraviolet absorbers, antioxidants, metal powders, mica powders and the like.

(Article)

The article of the present invention includes a chromium plated base material and a coating film made of the coating material composition for chromium plating of the present invention formed on the chromium plated surface of the base material.

Examples of the base material include plastic base material such as ABS resin, polycarbonate or the like, and metal base material such as steel or the like.

Examples of the method for chromium plating treatment include known methods for plating treatment.

In view of an improvement in adhesion of the coating film to the chromium plated surface, the chromium plated surface of the base material is preferably pretreated with an organic silicon compound. Examples of the method for the treatment include a method of coating an organic silicon compound on the chromium plated surface of a base material. Examples of the organic silicon compound include the above compounds (B), (C) and the like. Among these compounds, 3-(meth) acryloyloxypropyltrimethoxysilane and tetramethoxysilane are particularly preferable because of high effect of improving adhesion of the coating film to the chromium plated surface.

The coating film is formed by mixing the coating material composition for chromium plating of the present invention, a solvent, a leveling agent and the like to prepare a coating material, and coating the coating material on the chromium plated surface of a base material, followed by drying.

Examples of the solvent include ketone-based solvent such as acetone, methyl ethyl ketone, dimethyl ethyl ketone, methyl isobutyl ketone or the like; ester-based solvent such as ethyl acetate, butyl acetate or the like; hydrocarbon-based solvent such as toluene, xylene, naphtha or the like; alcohol-based solvent such as 2-butoxyethanol or the like; and ethylene glycol monoethyl ether acetate or the like.

As the coating method, for example, spray coating, flow coating, dipping, brush coating, roll coating methods and the like can be used.

The thickness of the coating film is preferably from 10 to 100 μm.

EXAMPLES

The present invention will be described in detail by way of the following examples.

Measurements in Synthesis Examples 1 to 18 were conducted by the following procedures.

(Non-volatile Component (NV))

NV of a vinyl-based polymer (A) solution was determined as follows. That is, 2 g of a coating material was weighed in a simple cap and dried in a constant-temperature bath at 105° C. for 3 hours, and then a tare of the cap was subtracted from the weight of the cap after drying and a weight ratio of the resulting weight to the weight of the coating material collected initially was determined and taken as NV.

(Weight-average Molecular Weight (Mw))

Mw of a vinyl-based polymer (A) was determined as a styrene equivalent weight-average molecular weight using a GPC apparatus manufactured by JASCO Corporation.

(Glass Transition Temperature (Tg))

Tg of a vinyl-based polymer (A) was calculated using the above FOX's equation.

Synthesis Example 1

In a reactor equipped with a stirrer, a thermometer, a nitrogen introducing tube and a reflux condenser, 50 parts by weight of toluene and 50 parts by weight of iso-butanol were charged and then; heated to 100° C. under a nitrogen atmosphere. While maintaining the temperature in the reactor at 100° C., a mixture of 10 parts by weight of methyl methacrylate (MMA), 64 parts by weight of n-butyl methacrylate (BMA), 16 parts by weight of n-butyl acrylate (BA), 10 parts by weight of dimethylaminoethyl methacrylate (DMMA) and 1 part by weight of azobisisobutylnitrile (AIBN) was added dropwise over 90 minutes. After the completion of the dropwise addition, the reaction solution was maintained at 100° C. for one hour and 0.2 parts by weight of AIBN was added. After maintaining at 100° C. for 30 minutes, 0.5 parts by weight of AIBN was further added. After maintaining at 100° C. for 3.5 hours to obtain a vinyl based polymer (A1) solution. NV, Mw and Tg are shown in Table 1.

Synthesis Examples 2 to 11

Under the same conditions as those in Synthesis Example 1, except that each amount of MMA, BMA and BA was replaced by the amount shown in Table 1 and polymerization was conducted under the same conditions, vinyl-based polymers (A2) to (A11) each having a different Tg were obtained. NV, Mw and Tg are shown in Table 1.

TABLE 1

| | | Synthesis Examples | | | | | | | | | | |
|---|---|---|---|---|---|---|---|---|---|---|---|---|
| | | 1 | 2 | 3 | 4 | 5 | 6 | 7 | 8 | 9 | 10 | 11 |
| | | Vinyl-based polymer (A) | | | | | | | | | | |
| | | A1 | A2 | A3 | A4 | A5 | A6 | A7 | A8 | A9 | A10 | A11 |
| Amount charged (parts by weight) | MMA | 10 | 17 | 25 | 32 | 40 | 47 | 53 | 66 | 71 | 75 | 81 |
| | BMA | 64 | 57 | 49 | 42 | 34 | 27 | 21 | 8 | 8 | 8 | 6 |
| | BA | 16 | 16 | 16 | 16 | 16 | 16 | 16 | 16 | 11 | 7 | 3 |
| | DMMA | 10 | 10 | 10 | 10 | 10 | 10 | 10 | 10 | 10 | 10 | 10 |
| NV (% by weight) | | 50 | 50 | 50 | 50 | 50 | 50 | 50 | 50 | 50 | 50 | 50 |
| Tg (° C.) | | 10 | 15 | 20 | 25 | 30 | 35 | 40 | 50 | 60 | 70 | 80 |
| Mw (× 1000) | | 30 | 30 | 30 | 30 | 30 | 30 | 30 | 30 | 30 | 30 | 30 |

Synthesis Examples 12 to 16

Under the same conditions as those in Synthesis Example 1, except that each amount of MMA, BMA and DMMA was replaced by the amount shown in Table 2 and polymerization was conducted under the same conditions, vinyl-based polymers (A12) to (A16) each having a different DMMA were obtained. NV, Mw and Tg are shown in Table 2.

Synthesis Example 17

Under the same conditions as in Synthesis Example 4, except that the amount of AIBN to be added first time was adjusted to 3 parts by weight, a vinyl-based polymer (A17) having tow Mw was obtained. NV, Mw and Tg are shown in Table 2.

Synthesis Example 18

In a reactor equipped with a stirrer, a thermometer, a nitrogen introducing tube and a reflux condenser, 50 parts by weight of toluene and 20 parts by weight of iso-butanol were charged and then heated to 100° C. under a nitrogen atmosphere. While maintaining the temperature in the reactor at 100° C., a mixture of 32 parts by weight of MMA, 42 parts by weight of BMA, 16 parts by weight of BA, 10 parts by weight of DMMA and 0.2 parts by weight of AIBN was added dropwise over 90 minutes. After the completion of the dropwise addition, the reaction solution was maintained at 100° C. for one hour and 0.2 parts by weight of AIBN and 30 parts by weight of iso-butanol were added. After maintaining at 100° C. for 30 minutes, 1.3 parts by weight of AIBN was added. After maintaining at 100° C. for 3.5 hours, a vinyl-based polymer (A18) having high Mw was obtained. NV, Mw and Tg are shown in Table 2.

TABLE 2

| | | Synthesis Examples | | | | | | | |
|---|---|---|---|---|---|---|---|---|---|
| | | 4 | 12 | 13 | 14 | 15 | 16 | 17 | 18 |
| | | Vinyl-based polymer (A) | | | | | | | |
| | | A4 | A12 | A13 | A14 | A15 | A16 | A17 | A18 |
| Amount charged (parts by weight) | MMA | 32 | 32 | 32 | 32 | 32 | 32 | 32 | 32 |
| | BMA | 42 | 47 | 37 | 32 | 27 | 32 | 42 | 42 |
| | BA | 16 | 16 | 16 | 16 | 16 | 16 | 16 | 16 |
| | DMMA | 10 | 5 | 15 | 20 | 25 | 30 | 10 | 10 |

TABLE 2-continued

| | Synthesis Examples | | | | | | | |
|---|---|---|---|---|---|---|---|---|
| | 4 | 12 | 13 | 14 | 15 | 16 | 17 | 18 |
| | Vinyl-based polymer (A) | | | | | | | |
| | A4 | A12 | A13 | A14 | A15 | A16 | A17 | A18 |
| NV (% by weight) | 50 | 50 | 50 | 50 | 50 | 50 | 50 | 50 |
| Tg (° C.) | 25 | 25 | 25 | 25 | 25 | 25 | 25 | 25 |
| Mw (× 1000) | 30 | 30 | 30 | 30 | 30 | 30 | 12 | 85 |

Example 1

200 Parts by weight (NV: 100 parts by weight, 90% by weight in 100% by weight of the total amount of a vinyl-based polymer (A) and a compound (B)) of a vinyl-based polymer (A1) solution, 17 parts by weight (10% by weight in 100% by weight of the total amount of a vinyl-based polymer (A) and a compound (B)) of 3-glycidoxypropyltrimethoxysilane as a compound (B), 2.8 parts by weight of an ultraviolet absorber (Manufactured by Ciba Geigy Co., TINUVIN 384), 1.2 parts by weight of a photostabilizer (manufactured by Ciba Geigy Co., LS292), 1.2 parts by weight of a leveling agent (manufactured by KYOEISHA CHEMICAL CO., LTD., GLANOL 200) and 274.8 parts by weight of a solvent mixture were mixed to prepare a coating material. The solvent mixture used contains 8.7% by weight of ethyl acetate, 72.3% by weight of toluene and 19% by weight of xylene.

On the chromium plated surface of a chromium plated ABS resin plate (manufactured by Nippon Testpanel Co., Ltd.), the resulting coating material was spray coated, followed by drying at 70° C. for 30 minutes and further standing under an atmosphere of 25° C. and 55% RH for 7 days to form a coating film having a thickness of 25±2 μm, and thus specimens were obtained. The resulting specimens were subjected to the following evaluation tests. The results are shown in Table 3.

(1) Initial Adhesion

Adhesion was evaluated by a cross cut-tape method, a cross-cut adhesion test in accordance with JIS K 5400. Specifically, vertical cut lines and horizontal cut lines were formed at an interval of about 1 mm respectively so as to form 100 squares, followed by adhering an adhesive cellophane tape thereonto, and strongly separating tape to count the number of squares peeled from the chromium plated surface.

(2) Adhesion After Water Resistance Test

A specimen was dipped in warm water at 40° C. for 240 hours. After taking out from warm water and removing moisture on the surface of the coating film, the specimen was allowed to stand until the surface temperature is cooled to room temperature and adhesion was evaluated by a cross cut-tape method, a cross-cut adhesion test in accordance with JIS K 5400.

(3) Adhesion After Weather Resistance Degradation Test

Using Sunshine Weather Meter manufactured by SUGA TEST INSTRUMENTS CO., LTD., an accelerated weathering test was conducted for 400 hours and a specimen was dipped in warm water at 40° C. for 48 hours. After taking out from warm water and removing moisture on the surface of the coating film, the specimen was allowed to stand until the surface temperature is cooled to room temperature. With respect to the specimen subjected to this operation twice, adhesion was evaluated by a cross cut-tape method, a cross-cut adhesion test in accordance with JIS K 5400.

(4) Acid Resistance

On a coating film, about 0.2 ml of an aqueous 3 wt % sulfuric acid solution was dropped and, after standing at 22° C. for 4 hours, appearance was visually observed.

Acid resistance was evaluated by the following criteria.

A: no color change of coating film

B: no color change of coating film, reduced gloss

C: color change of coating film (5) Gasoline Resistance

A specimen was dipped in a lead-free regular gasoline for 30 minutes and, after wiping off gasoline, appearance of the coating film was visually observed.

Gasoline resistance was evaluated by the following criteria.

A: no swelling of coating film, no gasoline residue

B: no swelling of coating film, gasoline residue

C: swelling of coating film, gasoline residue (6) Evaluation After Standing Under Wet Atmosphere With respect to a specimen which was allowed to stand under an atmosphere of 50° C. and 95% RH for 96 hours, the above evaluation tests (1) to (5) were conducted.

Adhesion in the tests (1) to (3) and (6) was evaluated by the following criteria.

6: number of squares peeled from chromium plated surface of coating film is 0, no peeled portion 5: number of squares peeled from chromium plated surface of coating film is 0, slight omission in the cross cut portion 4: number of squares peeled from chromium plated surface of coating film is 0, slight point peeling 3: number of squares peeled from chromium plated surface of coating film is from 1 to 10, medium point peeling 2: number of squares peeled from chromium plated surface of coating film is from 11 to 50, considerable point peeling 1: number of squares pealed from chromium plated surface of coating film is 51 or more, surface peeling occurred Examples 2 to 4 and Comparative Examples 1 to 7

In the same manner as in Example 1, coating materials were prepared using the vinyl-based polymers (A2) to (A11) and specimens were made. With respect to each specimen, the evaluation tests (1) to (6) were conducted. The results are shown in Table 3. Also the results of each adhesion (initial adhesion, adhesion after water resistance test, and adhesion after weather resistance degradation test) after standing under a wet atmosphere are shown in a graph of FIG. 1.

TABLE 3

| | | Examples | | | | Comparative Examples | | | | | | |
|---|---|---|---|---|---|---|---|---|---|---|---|---|
| | | 1 | 2 | 3 | 4 | 1 | 2 | 3 | 4 | 5 | 6 | 7 |
| | | Vinyl-based polymer (A) | | | | | | | | | | |
| | | A1 | A2 | A3 | A4 | A5 | A6 | A7 | A8 | A9 | A10 | A11 |
| | | Tg (° C.) | | | | | | | | | | |
| | | 10 | 15 | 20 | 25 | 30 | 35 | 40 | 50 | 60 | 70 | 80 |
| Immediately after production | Initial adhesion | 6 | 6 | 6 | 6 | 6 | 6 | 6 | 6 | 6 | 5 | 4 |
| | Water resistance | 6 | 6 | 6 | 6 | 6 | 6 | 6 | 6 | 5 | 5 | 4 |
| | Weather resistance deterioration | 6 | 6 | 6 | 6 | 1 | 1 | 1 | 1 | 1 | 1 | 1 |
| Standing in wet atmosphere | Initial adhesion | 6 | 6 | 6 | 6 | 6 | 6 | 6 | 6 | 6 | 5 | 4 |
| | Water resistance | 6 | 6 | 6 | 6 | 6 | 6 | 6 | 6 | 5 | 4 | 4 |
| | Weather resistance deterioration | 6 | 6 | 6 | 6 | 1 | 1 | 1 | 1 | 1 | 1 | 1 |

When Tg of the vinyl-based polymer (A) is too high, initial adhesion and adhesion after the water resistance test are slightly deteriorated. When Tg of the vinyl-based polymer (A) is 30° C. or higher, adhesion after the weather resistance degradation test is rapidly deteriorated. As is apparent from the above results, adhesion to the chromium plated surface of the coating film can be maintained for a long period by adjusting Tg of the vinyl-based polymer (A) to lower than 30° C.

Examples 5 to 6 and Comparative Examples 8 to 10

In the same manner as in Example 1, coating materials were prepared using the vinyl-based polymers (A12) to (A16) and specimens were made. With respect to each specimen, the evaluation tests (1) to (5) were conducted. The results are shown in Table 4.

TABLE 4

| | | Examples | | | Comparative Examples | | |
|---|---|---|---|---|---|---|---|
| | | 5 | 4 | 6 | 8 | 9 | 10 |
| | | Vinyl-based polymer (A) | | | | | |
| | | A12 | A4 | A13 | A4 | A5 | A6 |
| | | DMMA (parts by weight) | | | | | |
| | | 5 | 10 | 15 | 20 | 25 | 30 |
| Immediately after production | Initial adhesion | 6 | 6 | 6 | 6 | 6 | 6 |
| | Water resistance | 6 | 6 | 6 | 6 | 6 | 4 |
| | Weather resistance deterioration | 6 | 6 | 6 | 6 | 5 | 3 |
| | Acid resistance | A | A | B | C | C | C |
| | Gasoline resistance | B | A | A | A | A | A |

When the amount of DMMA of the vinyl-based polymer (A) is large, adhesion to the chromium plated surface of the coating film and acid resistance of the coating film tend to be deteriorated. On the other hand, when the amount of DMA of the vinyl based polymer (A) is small, gasoline resistance of the coating film tends to be deteriorated. As is apparent from the above results, balance between adhesion, acid resistance and gasoline resistance of the coating film is improved by adjusting the amount of the vinyl-based monomer having an amino group as a raw material of the vinyl-based polymer (A) to 5% by weight or more and less than 20% by weight.

Examples 7 to 8

In the same manner as in Example 1, coating materials were prepared using the vinyl-based polymers (A17) and (A18) and specimens were made. With respect to each specimen, the evaluation test (6) was conducted. The results are shown in Table 5.

TABLE 5

| | | Examples | | |
|---|---|---|---|---|
| | | 7 | 4 | 8 |
| Vinyl-based polymer (A) | | A17 | A4 | A18 |
| Mw (×1000) | | 12 | 30 | 85 |
| Immediately after production | Initial adhesion | 6 | 6 | 6 |
| | Water resistance | 6 | 6 | 6 |
| | Weather resistance deterioration | 6 | 6 | 6 |
| | Acid resistance | A | A | A |
| | Gasoline resistance | B | A | A |

When the vinyl-based polymer (A) has low Mar, gasoline resistance was slightly inferior, but is practically satisfactory. On the other hand, when the vinyl-based polymer (A) has high Mw, stringiness occurred during spray coating and coatability was slightly inferior. Provided that adhesion of the coating film does not depend on Mw of the vinyl-based polymer (A).

Example 9

200 Parts by weight (NV: 100 parts by weight, 77% by weight in 100% by weight of the total amount of a vinyl-based polymer (A), a compound (B) and a compound (C)) of a vinyl-based polymer (A4) solution, 20 parts by weight (10.2% by weight in 100% by weight of the total amount of a vinyl-based polymer (A) and a compound (B)) of 3-glycidoxypropyltrimethoxysilane as a compound (B), 20 parts by weight (12.8% by weight in 100% by weight of the total amount of a vinyl-based polymer (A), a compound (B) and a compound (C)) of a mixture of a partial hydrolyzate condensate (C1) of tetramethoxysilane (manufactured by Nippon Unicar Company Limited, AZ6202) and a partial hydrolyzate condensate (C2) of tetramethoxysilane (manufactured by Tama Chemicals Co., Ltd., SILICATE 40) (weight ratio C1/C2=⅓) as a compound (C), 2.8 parts by weight of an ultraviolet absorber (manufactured by Ciba Geigy Co., TINUVIN 384), 1.2 parts by weight of a photostabilizer (manufactured by Ciba Geigy Co., LS292), 1.2 parts by weight of a leveling agent (manufactured by KYOEISHA CHEMICAL CO., LTD., GLANOL 200) and 238.8 parts by weight of the above solvent mixture were mixed to prepare coating materials. In the same manner as in Example 1, specimens were made. With respect to each specimen, the evaluation tests (1) to (6) were conducted. Also the evaluation tests (7) to (9) were conducted. With respect to the specimen of Example 4, the evaluation tests (7) to (9) were conducted. The results are shown in Table 6.

(7) Pencil Hardness

A scratch test was conducted by contacting a pencil Hi-uni manufactured by MITSUBISHI PENCIL CO, LTD. with the surface of a coating film and pushing against at a force smaller than the force which causes fracture of the lead of the pencil. Judgment was conducted by the breakage of the coating film.

(8) Wax Remover Resistance

A specimen was dipped in a wax removing solution (manufactured by YUSHIRO CHEMICAL INDUSTRY CO., LTD., ST-7) at 45° C. for 10 minutes and allowed to stand at room temperature for 24 hours, and then appearance was visually observed.

Wax remover resistance was evaluated by the following criteria.

A: no swelling of coating film, no wax removing solution residue

C: swelling of coating film, wax removing solution residue (9) Abrasion Resistance Using a sliding abrasion test machine, an abrasion debris covered with gauze was pushed against the surface of a coating film at a fixed load (500 g/cm$^2$) and, after reciprocating abrasion, the number of reciprocations until scratch is observed on the surface of the coating film was counted.

TABLE 6

| | | Examples | |
|---|---|---|---|
| | | 4 | 9 |
| Vinyl-based polymer (A) | | A4 | A4 |
| Addition of partial hydrolyzate condensates (C1) + (C2) | | not added | added |
| Immediately after production | Initial adhesion | 6 | 6 |
| | Water resistance | 6 | 6 |
| | Weather resistance deterioration | 6 | 6 |
| | Acid resistance | A | A |
| | Gasoline resistance | A | A |
| | Pencil hardness | 3B | H |
| | Wax remover resistance | C | A |
| | Wear resistance | 5,000 | 8,000 |

It is apparent that hardness, wax remover resistance and abrasion resistance of the coating film are improved by adding a mixture of a partial hydrolyzate condensate (C1) of tetramethoxysilane and a partial hydrolyzate condensate (C2) of tetramethoxysilane in a predetermined ratio.

The coating material composition for chromium platting of the present invention is useful as a coating material of chromium plated components such as radiator grille, license garnish of automobiles and the like.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A coating material composition for chromium plating, comprising a vinyl-based polymer (A) obtained by polymerizing a vinyl-based monomer mixture containing a vinyl-based monomer having an amino group, a compound (B) having an epoxy group and a hydrolyzable silyl group in a molecule, and a compound (C) having a hydrolyzable silyl group other than the compound (B), wherein the vinyl-based polymer (A) has a glass transition temperature of lower than 30° C., the content of the vinyl-based monomer having an amino group is 5% by weight or more and less than 20% by weight in the vinyl-based monomer mixture (100% by weight), and the compound (C) having a hydrolyzable silyl group that is a mixture of a partial hydrolyzate condensate (C1) of tetramethoxysilane and a partial hydrolyzate condensate (C2)of tetraethoxysilane.

2. The coating material composition for chromium plating according to claim 1, wherein a weight ratio of the partial hydrolyzate condensate (C1) to the partial hydrolyzate condensate (C2), (C1/C2), is from ½ to ¼.

3. An article comprising a chromium plated base material and a coating film made of the coating material composition for chromium plating according to claim 1 or 2 formed on the chromium plated surface of the base material.

4. The article according to claim 3, wherein the chromium plated surface of the base material is pretreated with an organic silicon compound.

* * * * *